United States Patent [19]

Kasevich

[11] Patent Number: 4,583,589

[45] Date of Patent: Apr. 22, 1986

[54] SUBSURFACE RADIATING DIPOLE

[75] Inventor: Raymond S. Kasevich, Weston, Mass.

[73] Assignee: Raytheon Company, Lexington, Mass.

[21] Appl. No.: 602,278

[22] Filed: Apr. 24, 1984

Related U.S. Application Data

[63] Continuation of Ser. No. 313,883, Oct. 22, 1981, abandoned.

[51] Int. Cl.[4] ..... E21B 36/04; E21B 43/24

[52] U.S. Cl. ..... 166/60; 166/248; 219/278; 343/719

[58] Field of Search ..... 343/719, 792, 793, 873; 166/60, 61, 248, 57, 65 R, 302, 306; 219/277, 278; 324/58.5 R, 330, 333

[56] References Cited

U.S. PATENT DOCUMENTS

| | | | |
|---|---|---|---|
| 2,757,738 | 8/1956 | Ritchey | 166/248 |
| 3,114,875 | 12/1963 | Haagensen | 324/1 |
| 3,133,592 | 5/1964 | Tomberlin | 166/60 |
| 3,170,519 | 2/1965 | Haagensen | 166/60 |
| 3,588,903 | 6/1971 | Hampton | 343/792 |
| 3,680,133 | 7/1972 | Tsao et al. | 343/719 |
| 3,713,166 | 1/1973 | Munson et al. | 343/792 |
| 4,140,179 | 2/1979 | Kasevich et al. | 166/248 |
| 4,373,581 | 2/1983 | Toellner | 166/248 |

*Primary Examiner*—Eli Lieberman
*Assistant Examiner*—Michael C. Wimer
*Attorney, Agent, or Firm*—Walter F. Dawson; Richard M. Sharkansky

[57] ABSTRACT

A system for in situ heating of oil shale by radiating electromagnetic wave energy from a dipole radiator positioned beneath an overburden in a body of oil shale. Radio frequency power is supplied from the surface through a transmission line to the radiator dipoles whose diameters are substantially greater than the spacing between the transmission line conductors. The dipole radiator is center fed by the transmission line through a reentrant choke structure substantially filled with a solid dielectric medium and concentric with one of said dipole elements.

23 Claims, 6 Drawing Figures

DISTANCE FROM MIDPOINT ALONG APPLICATOR IN WAVELENGTHS
1
.75
.50
.25
100
104
102
RELATIVE HEATING PATTERN

STANDING WAVE RATIO
5
4
3
2
106
110
108
Fø
FREQUENCY
1.15 Fø

SUBSURFACE RADIATING DIPOLE

This application is a continuation of application Ser. No. 313,883 filed Oct. 22, 1981, now abandoned.

BACKGROUND OF THE INVENTION

Radiators for heating oil shale of the type shown in U.S. Pat. No. 4,140,179, have a coaxially fed dipole radiator. However, directivity in the vertical plane of the radiation pattern has been poor.

In addition, for large diameter dipole radiating elements, a practical coaxial line, whose characteristic impedance would match the radiating impedance of the dipole structure, requires a very small size inner conductor which limits power. Otherwise, the diameter of the outer conductor of the coaxial transmission line becomes very large, and the transmission line structure becomes unduly expensive. Thus, when the radiator supplied by the transmission line structure is at a substantial depth, RF heating of oil shale in situ can become uneconomic.

SUMMARY OF THE INVENTION

In accordance with this invention, a dipole radiating structure is provided in which both halves of the dipole structure have substantially the same diameters. Good impedance matching from a coaxial line into this radiating structure can be achieved by direct coupling to a coaxial line whose outer conductor diameter is substantially less than the outer diameter of the dipole radiating elements.

More specifically, in accordance with this invention, a rigid coaxial line extends from an RF generator at the surface to said radiator, into one end of a hollow dipole radiator element of said dipole structure with said coaxial line outer conductor being electrically connected to said hollow dipole element adjacent the midpoint of said dipole structure. A coaxial choke is formed between the outer wall of the outer conductor and the inner wall of the dipole. In accordance with this invention, the major portion of the space between said walls is filled with a solid dielectric medium, and the size and dielectric constant of said dielectric medium is chosen to make the propagation velocity of RF energy in the choke substantially equal to the propagation velocity of said energy in the oil shale body. Such a structure has been found to have improved directivity and better impedance matching over a wide range of frequencies.

This invention further discloses that the lower half of said dipole radiator may be connected to the center conductor of said coaxial line. Said central conductor may extend up inside the outer conductor of said coaxial line to a point where a tensile stress is applied to said coaxial central conductor and longitudinal compressive stress is applied to said outer conductor which is in turn connected to the upper half of said dipole structure. This tension urges said lower dipole half against a dielectric block separating said dipole halves hence urging said upper dipole half against the end of the outer conductor of said coaxial line to form said dipole structure.

In accordance with this invention, each half of the dipole radiator may be approximately a quarter wavelength long while still maintaining substantially maximum intensity of the radiated pattern in a plane perpendicular to the axis of the dipole radiator at the center of the dipole. This permits a good impedance match of the dipole to the transmission line even when the frequency of the radiated power is varied over a bandwidth of 30 percent. When each half of the radiator dipole has a length which is approximately an odd number of quarter wavelengths, such as 3 quarter wavelengths, the frequency may be varied over 10 percent while still retaining good radiation pattern directivity and good impedance matching. Thus, since depth of penetration of the radiated wave into oil shale varies as a direct function of wavelength, the same radiator may be used to supply either a fundamental frequency in which the radiating system is a half wavelength long, or an odd harmonic thereof such as the third harmonic where each dipole half is $\frac{3}{4}$ of a wavelength. Since the third harmonic has a shorter wavelength, depth of penetration will be less so that regions closer to the radiator may be first heated to pyrolytic decomposition temperatures. Thus, in accordance with this invention, the formation may be heated first close to the radiator to produce gaseous and liquid products of pyrolytic decomposition of kerogen and may then be run at lower frequencies to heat regions of the oil shale at a greater distance from the radiator.

BRIEF DESCRIPTION OF THE DRAWINGS

Other and further objects and advantages of this invention will be apparent as the description thereof progresses, reference being had to the accompanying drawings wherein.

DESCRIPTION OF THE PREFERRED EMBODIMENT

Figure 1:
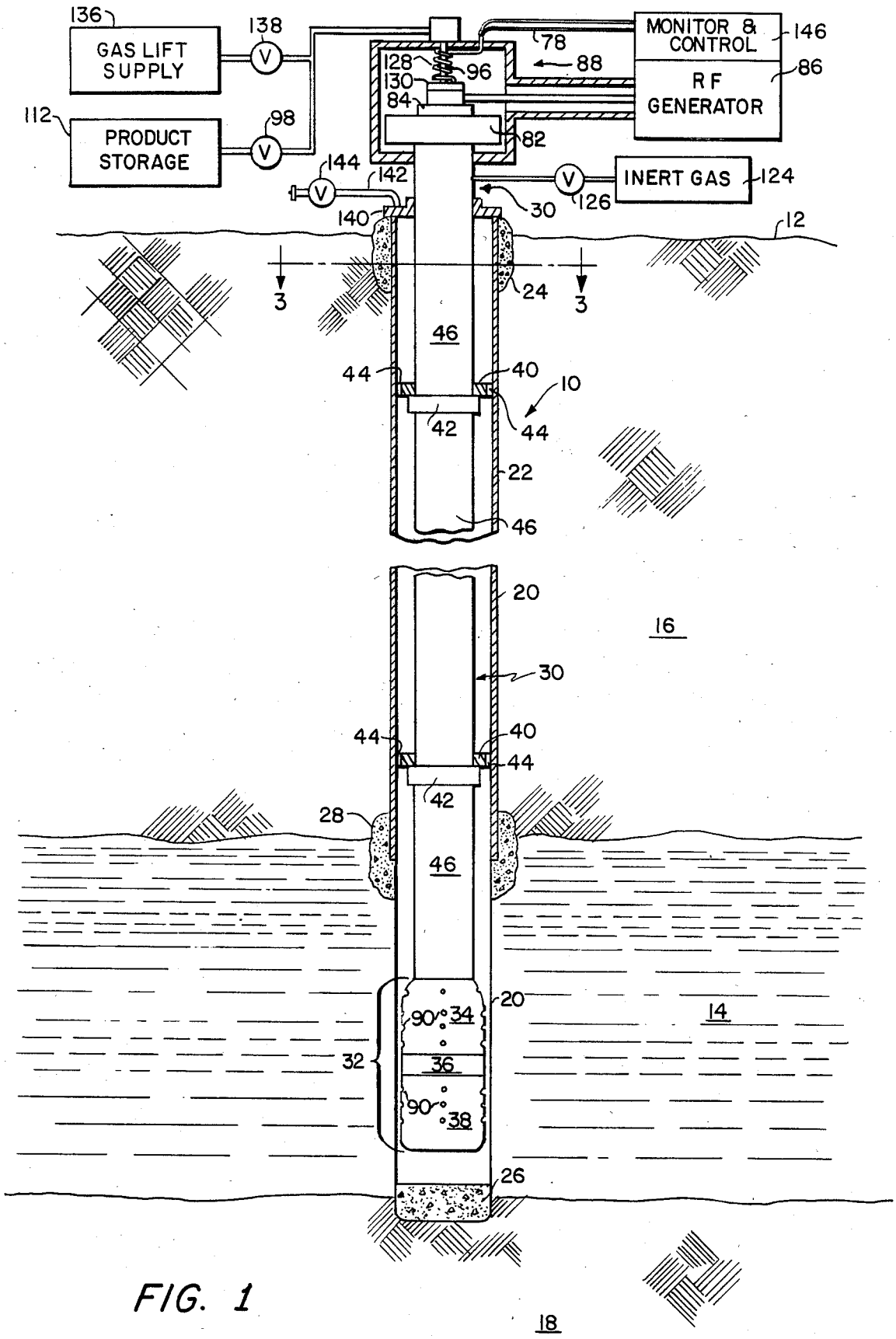
FIG. 1 illustrates a vertical sectional view of a subsurface installation of the invention in a body of oil shale.
Figure 2:
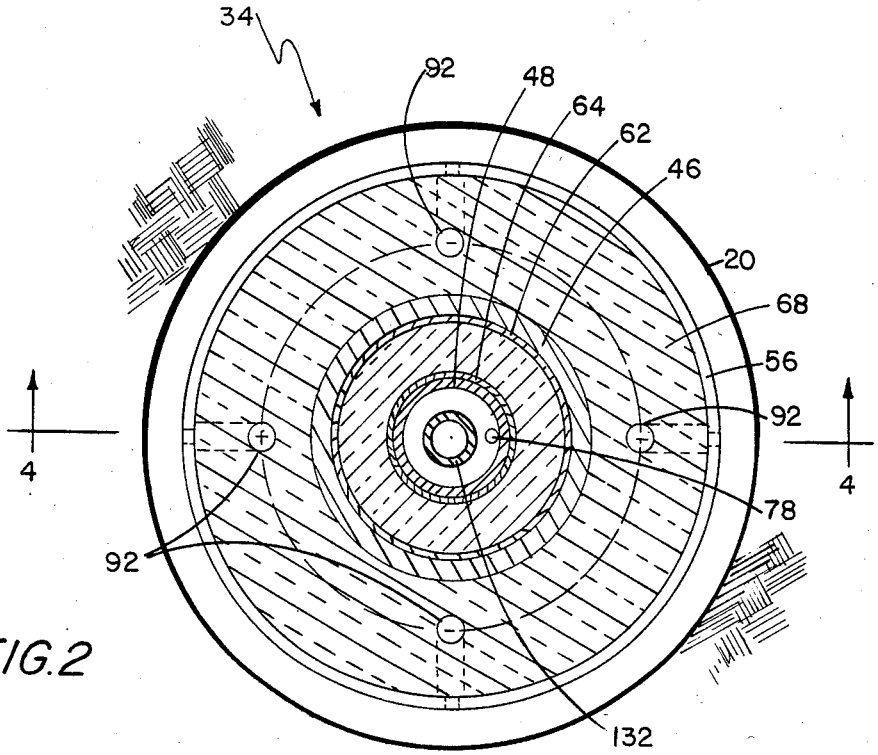
FIG. 2 illustrates an enlarged transverse sectional view of the invention of FIG. 1 taken along line 2—2 of FIG. 4.
Figure 3:
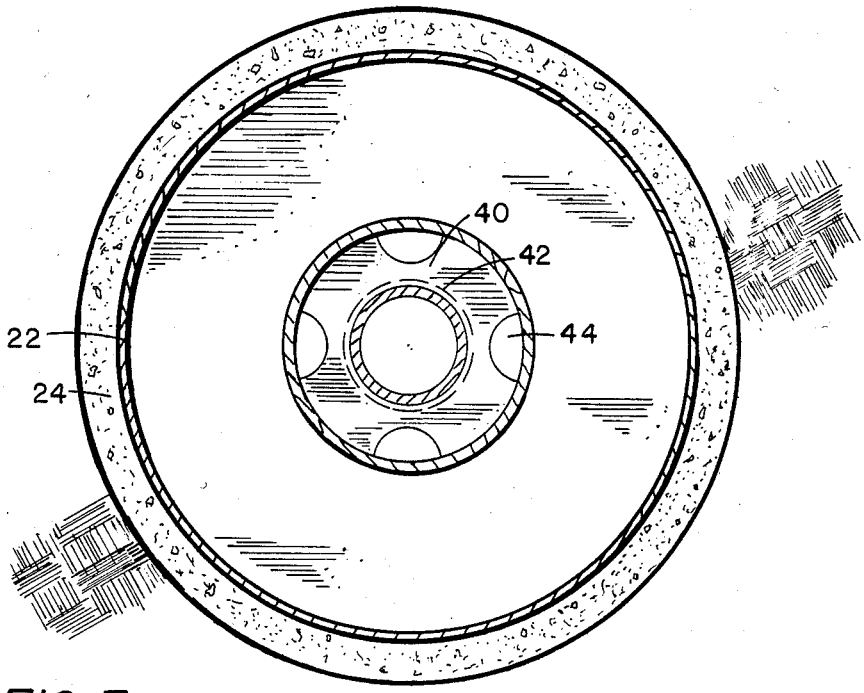
FIG. 3 illustrates an enlarged transverse sectional view of the invention of FIG. 1 taken along line 3—3 of FIG. 1.
Figure 4:
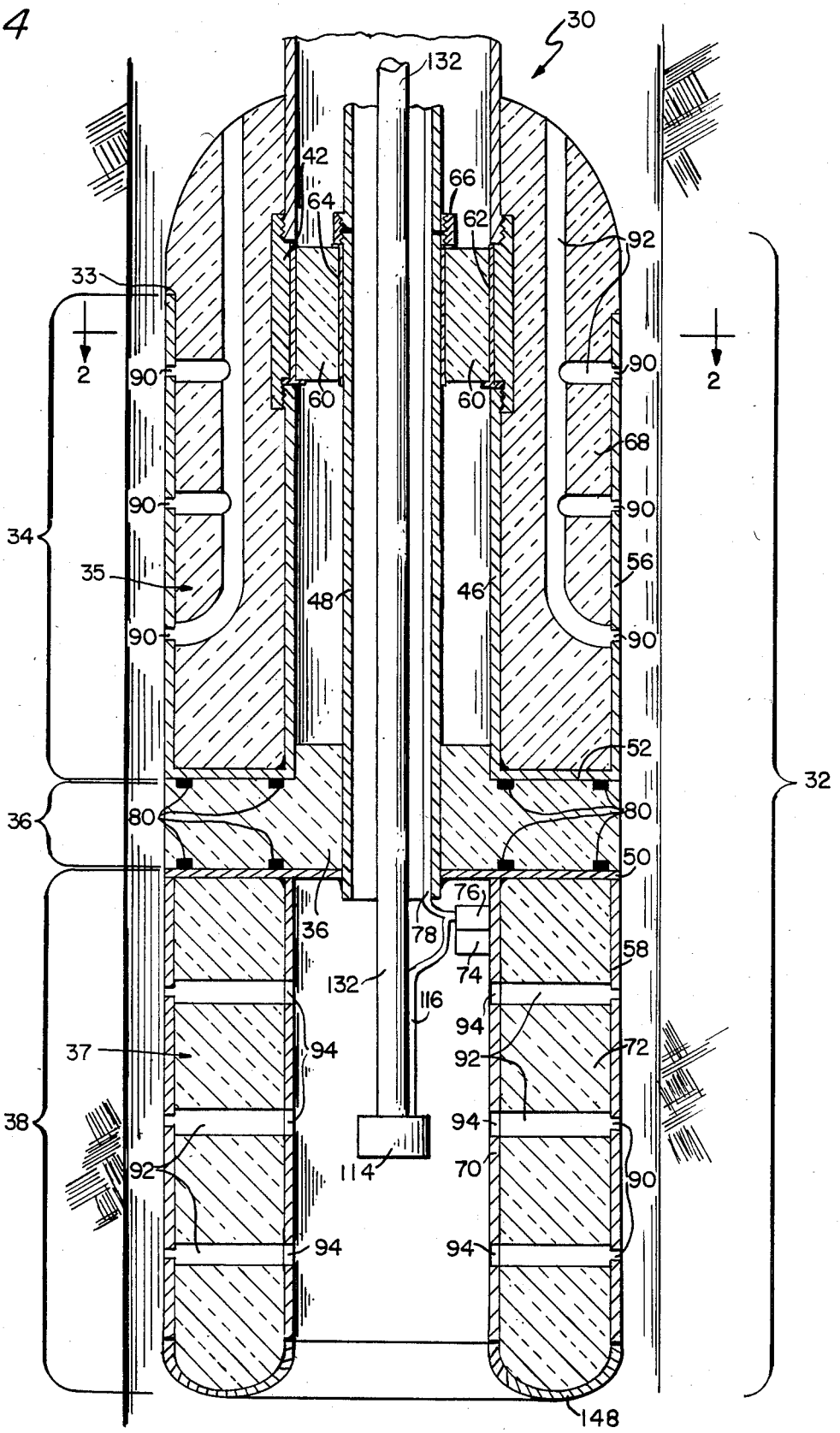
FIG. 4 illustrates an enlarged vertical sectional view of the radiator of FIG. 1 taken along line 4—4 of FIG. 2.

Referring now to FIGS. 1–4, there is shown a subsurface radiation system comprising a transmission line structure 10 extending from the surface 12 into a body 14 of oil shale beneath an overburden 16 and above a substrate 18. By way of example, a borehole 20, which may be, for example, 17 inches in diameter, is drilled from the surface 12 through the overburden 16 and substantially through the oil shale body 14 into the substrate 18. A casing 22 of, for example, inch thick steel and having a 17-inch outside diameter is driven down through bore 20 from the surface into the upper region of the oil shale body. A concrete ring 24 is poured around casing 22 adjacent the surface 12 to seal the casing into the overburden. In addition, a concrete pad 26 may be poured into the bottom of bore 20 to seal the lower portion of the oil shale body at or above the substrate 18. If desired, the lower end of casing 22 may also be sealed into the shale oil formation by pumping a body of concrete 28 down casing 22 when the borehole 20 has been drilled down to a point slightly below the upper surface of the shale oil body 14 and, after allowing the concrete body 28 to set up, drilling through the concrete to complete the bore 20.

In accordance with this invention, a coaxial radio frequency transmission line 30 extends through casing 22 into the oil shale formation 14 to supply RF energy to a dipole radiating structure 32. Structure 32 has an upper dipole radiating element 34, a central ceramic cylinder 36 and a lower dipole radiating element 38.

The coaxial line 30 has, for example, an outer diameter of $6\frac{5}{8}$ inches and may be spaced from the inner walls of casing 22 by spacers 40 which may be, for example, ceramic collars resting on couplings 42 connecting the length of the outer conductor 46 of coaxial line 30. Spacing collars 40 may have vertically extending passages 44 through which gas or liquids may pass between the surface and the upper portion of the bore 20.

The inside diameter of coaxial line outer conductor 46 is approximately 6 inches and surrounds an inner conductor 48 whose outer diameter is, for example, $2\frac{3}{4}$ inches. As illustrated herein, the inner conductor 48 preferably has a central bore which is approximately 2 inches in diameter, and the minimum cross-sectional area of the metal portion of inner conductor 48 is approximately $2\frac{3}{4}$ square inches. Since inner conductor 48 is preferably of high strength steel, it can be subjected to a tension in excess of 10 tons without exceeding its elastic limit even at elevated temperatures.

The lower end of inner conductor 48 is attached by welding to, or threading into a hole in, the center of a steel plate 50. Plate 50 is 14 inches in diameter, and supports the lower dipole radiator 38 beneath central ceramic cylinder 36. The upper surface of central ceramic cylinder 36 is contacted by a steel plate 52 having a circular aperture therein which is the same diameter as the inner diameter of coaxial line outer conductor 46. Plate 52, which has an outer diameter of 14 inches, is welded to the lower end of outer conductor 46 at the periphery of the aperture in plate 52 and to an outer radiating cylinder 56 of upper dipole radiator 34. Cylinder 56 has an outer diameter of 14 inches and extends upwardly from plate 52 to form the radiating surface of upper dipole half 34. A similar cylinder 58 is welded to plate 50 and extends downwardly therefrom to form the radiating surface of lower dipole member 38.

A ceramic spacing cylinder 60, approximately a foot long and fabricated of high strength dielectric such as alumina, is positioned between coaxial line outer conductor 46 and inner conductor 48. Ceramic spacing cylinder 60 may, for example, be strengthened by being prefabricated in a thin outer metal cylinder 62 having a lower lip engaging the lower outer corner of cylinder 60. Cylinder 62 is preferably snuggly fitted to the outer surface of spacing cylinder 60 at a temperature a few hundred degrees hotter than the hottest temperature to be encountered in the oil shale formation so that on cooling to room temperature, it will exert a substantial radial compressive force on the cylinder 60. An inner metal cylinder 64 engages the hole through ceramic spacing cylinder 60 and has a metallic lip engaging the upper surface of cylinder 60. Cylinders 62 and 64 are preferably made of high strength hardened steel so that the lips may have substantial force exerted thereon. The cylinder 64 engages a coupling 66 which threadably attaches the section of inner conductor 48 which is welded to plate 50 to the next higher section, and the lip on cylinder 62 rests on the upper end of the lowest section of outer conductor 46. By grasping the inner surface of inner conductor 48 with a conventional internal clamp, a tension may be applied to the lowest section of inner conductor 48, while exerting a downward force on an outer clamp engaging coaxial line outer conductor 46, to stretch this portion of inner conductor 48 by one percent or so. The ceramic spacing cylinder 60 and rings 62 and 64 may then be slid on the end of the lower section of inner conductor 48 and the coupling 66 threadably attached to hold the ceramic spacing cylinder 60 in place. On release of the tension on the lower section of inner conductor 48, the portion of coaxial line outer conductor 46 below the ceramic cylinder 60 will be in compression and the lower portion of the inner conductor attached to plate 50 will be in tension. As a result, the lower dipole half will be attached to the upper dipole half firmly grasping the upper and lower surfaces of central ceramic cylinder 36.

In order to suitably reinforce the structure against compressive forces, the space between coaxial line outer conductor 46 and the outer radiating cylinder 56 is substantially filled with a solid dielectric 68. The dielectric 68 is preferably structurally strong in compression, has a suitably low attenuation at RF frequencies, and has a suitably high dielectric strength so that voltage breakdown in the dielectric 68 will not occur when the system is used with high RF power.

If desired, the lowest section of coaxial line outer conductor 46, which is between the ceramic spacing cylinder 60 and the plate 52, may be made of a metal having a higher thermal coefficient of expansion than that of outer radiating cylinder 56. For example, if cylinder 56 is steel, this lowest section of conductor 46 may be high strength aluminum. Then, as temperature is increased several hundred degress, this portion of conductor 46 will expand axially as well as radially at a greater rate than cylinder 56 thereby maintaining the dielectric 68 under radial compression.

A pipe 70, for example of the same diameter as conductor 46, may be welded to plate 50 and extend downwardly therefrom at least to the bottom of the lower dipole cylinder 58. The space 37 between pipe 70 and cylinder 58 may be filled with a solid dielectric 72 or other solid material in a fashion similar to dielectric 68. The lower end of pipe 70 may be connected to the lower end of cylinders 58 by a curved plate 148 to eliminate sharp corners. The dielectric 68 may extend beyond the open end 33 of the cylinder 56 as shown so that regions of maximum field gradient of the radiated wave will be within a solid dielectric.

The interior of pipe 70 can contain sensing devices such as a pressure sensor 74 and a thermal sensor 76 which may telemeter pressure and temperature information to the surface via a shielded cable 78 whose shield is electrically grounded to the inside surface of inner conductor 48. Because the dielectrics 68 and 72 reinforce the cylinders 56 and 58 against radial thrust forces produced by the oil shale when heated, the dipoles 34 and 38 can withstand very severe lateral forces which may be exerted on them due to radial inward thrust produced by thermal expansion of the oil shale body 14 when heated by RF energy.

In addition, the cavity 35 containing the solid dielectric 68 acts as a resonant radiator load whose impedance is substantially greater than the input impedance of the antenna in the oil shale. This high impedance is coupled to the upper end of the upper dipole radiator 34. It has been discovered that the impedance of the input to the antenna structure 32 is influenced to a large degree when a low impedance or non-resonant load is coupled to the upper end of cylinder 56. However, when this load is a high impedance, for example, by resonating the load inside cylinder 56, the antenna input impedance is substantially unaffected. Even though there is an air space initially between the edge of the original borehole 20 and the radiating surfaces of the cylinders 56 and 58, a relatively good impedance match will occur. Thus, the coaxial transmission line 30 can be chosen to have an impedance substantially matched to the radiation impedance of dipole radiating structure 32 when the oil shale body 14 has been heated and expanded into physical contact with the entire outer surfaces of the cylinders 56 and 58. Applicant has discovered that such improved impedance matching characteristics over a relatively wide bandwidth such as 20–30% can occur provided the dielectric 68 has a relatively high dielectric constant, such as 5 to 10. This approximates the dielectric constant of the oil shale body which can be 8 to 16 for unpyrolized oil shale.

In order to maintain a high dielectric strength in transmission line 30, provision is preferably made for introducing and maintaining an inner atmosphere of, for example, argon or nitrogen under pressure in the space between inner conductor 48 and outer conductor 46. For this purpose, metallic O-ring gas-tight seals 80 are positioned in grooves in central ceramic cylinder 36 contacting the plates 50 and 52. The upper end of outer conductor 46 is closed by a ceramic insulating block 82 through which inner conductor 48 extends with block 82 being sealed to the top of outer conductor 46 by stretching inner conductor 48 upwards with a force of several thousand pounds and threading onto a flanged coupling 84 onto the upper end of conductor 48. Coupling 84 engages the upper surface of ceramic block 82 on the upper end of conductor 48. Gas-tight metal O-ring seals (not shown) may also be placed in annular grooves (not shown) in the upper and lower surfaces of ceramic block 82 to engage the lower surface of coupling 84 and the top of conductor 46 respectively. Inert gas from a pressure tank 124 is connected into outer conductor 46 through a control valve 126.

An RF generator 86 is coupled to the upper end of transmission line 30 through a coaxial cable and shielding structure 88 by connecting the central conductor of cable 88 to coupling 84. The shielded telemetering cable 78, which may also supply power, may be fed through the central conductor and through a hollow conductive coil 128 to suitable instruments in a monitor and/or control circuitry module 146 for controlling the power level and/or timing sequence of the RF power supplied from generator 86 to the dipole radiating structure 32. Hollow coil 128, which may be 1-inch copper tubing, acts as an RF choke at the frequency of generator 86. One end of the choke coil 128 is grounded to the outer shield portion of coaxial structure 88, and the other end thereof is threaded into a metal plug 130 which is in turn threaded into coupling 84.

The gas or liquid in cylinder 70 may be produced through a tubing 132 extending through inner conductor 48 and through a ceramic insulating pipe 96 which extends along the axis of coil 128 and through outer shield 88 to connect via a valve 98 to a product storage tank 112. A pump 114 at the lower end of tubing 132 and supplied with electric power via a shielded cable section 116 incorporated in shield cable 78, pumps such gas or liquid up through tubing 132. Alternatively, gas generated within the formation, or injected into cylinder 70 from a gas pressure tank 136 through a control valve 138 and tubing 132, can be used to drive liquid up tubing 132 into tank 112 when valve 138 is closed and valve 98 is opened.

It should be clearly understood that other structures in place of dielectric filled cavity 35 could be used to endload the radiating cylinder 56 and that the cylinder 56 could be operated with the dielectric 68 having an electrical length which is any odd multiple of a quarter wavelength.

The high power applicator of this invention can be used with patterns of several such radiators preferably one-half wavelength spaced in the oil shale. Examples of various patterns are set forth in my aforementioned patent.

Gases or liquids trapped between the oil shale and the cylinders 56 or 58 may be released by passing through apertures 90 in the cylinders 56 and 58 which communicate through passages 92 cast in the dielectrics 68 and 72. Passages 92 in turn lead to openings in the upper surface of the dielectric 68 or to apertures 94 in pipe 70.

DESCRIPTION OF THE PREFERRED MODE OF OPERATION

In operation, the dipole radiating structure is lowered into the bore 20 in the body of shale 14. An inert gas is then introduced into the transmission line structure 30 through valve 126 to pressurize the transmission line structure 30 with a pressure of one or more atmospheres. The well bore is then preferably purged with an inert gas introduced, for example, through inner conductor 48 and allowed to purge through casing 22 and a vent 142 in a casing seal 140. The outlet from the casing seal vent 142 is then closed by closing vent valve 144 and a pressure of one or more atmospheres of the inert gas allowed to build up in the bore 20.

RF power at a level of, for example, 50 kilowatts and a frequency of 10–15 megahertz is applied to the transmission line 30 from the RF generator 86.

Preferably, the frequency chosen produces a maximum or resonant impedance across the choke between the free end 33 of the radiating cylinder 56 and the outer surface of the outer conductor 46. In practice, if the space is filled with a dielectric such as the commercially available high temperature insulating material, Sauerisen, a dielectric constant of 5 to 6 will be present in the choke medium 68. A loss tangent of this dielectric material may be, for example, between 0.005 and 0.01. If the tank circuit is steel, a Q of 5 to 15 will occur. When the distance from the free end 33 of the cylinder 56 to the steel plate 50 is a quarter wavelength, resonance will occur. For example, in the presence of oil shale, this dipole length is approximately 5 meters for resonance at a frequency of around 11 to 13 megahertz. For the dimensions given for the choke, a figure of merit "Q" of 10 will produce an impedance of 150 to 200 ohms at the free end 33 of cylinder 56. Because the Q is relatively low, this impedance range will be achieved over a relatively wide range of frequencies such as from 10 to 14 megahertz. As the dielectric choke 68 is heated, for example, to as high as 500° C., the dimensions of the choke cavity will change relatively little. However, if desired, shifting of the frequency at the RF generator can bring the dielectric choke 68 back into resonance. It has been discovered that at choke resonance, even with an air gap between the radiating surface and the oil shale body 14, the antenna current at the outer end of radiator cylinder 56 will be reduced by as much as 30 db from the antenna current fed to the midpoint of the dipole radiator. For this purpose, the length of the radiating cylinder 56 of the upper half of dipole 34 is chosen such that it will be substantially a quarter wavelength including one-half the thickness of the dielectric cylinder 36 and with a dielectric constant for the oil shale body of around 10. While the dielectric constant of unheated oil shale, which may contain several percent water, may be as high as 16, and the dielectric constant of spent shale, that is, shale which has been heated to produce substantially complete pyrolytic decomposition and removal of kerogen, can be under 5. Under these conditions, the oil shale heating pattern in the vertical plane will be substantially more directive than a conventional air core reentrant dipole.

As the oil shale is heated, it is forced by thermal expansion into close contact with the radiating surface 56 of the upper dipole 34 improving the radiation coupling to the oil shale body. This can occur even though the length of the radiating dipole surface becomes appreciably less than a quarter wavelength in the oil shale.

In addition, since a cylindrical dipole of the dimensions described herein will have a radiation impedance of around 50 ohms when radiating into an energy absorbing medium such as oil shale, change of this impedance is relatively small when the free end 33 of the dipole is maintained at a relatively high impedance, such as 100 ohms or greater. Thus, it may be seen that if the coaxial transmission line is designed for approximately 50 ohms, it will stay substantially matched to the radiator as the oil shale body is heated and as the kerogen in the oil shale is pyrolytically converted to its decomposition products which are pumped or forced up the central conductor 48 by the pressure of gas generated in the oil shale and diffusing into the bore 20.

As the portions of oil shale around the radiator become heated and the kerogen in the oil shale decomposes into oil and gas, the absorption of the RF energy adjacent bore 20 may become reduced partly because the products of decomposition have a lower loss tangent and partly because this region now has a lower average dielectric constant. This allows a local expansion of the heated ring of oil shale spaced around the radiator at which kerogen is then decomposing and producing gas which forces the gaseous and liquid products of such decomposition into the bore 20. It also somewhat relieves the oil shale thermal expansion force on the external surfaces of the dipole radiator. In the absence of a resonance between the upper dipole cylinder 56, and the outer conductor 46, the impedance at the upper end 33 of the upper dipole radiator would approximate 15 to 20 ohms, and the pattern of radiation would be much broader while much of the radiating currents would be lost back up the outside of the coaxial line.

The lower dipole radiator 38 does not have its lower end loaded by a low impedance since it is spaced far away from any other conductor. Hence, no resonant choke is required, and the lower ends of cylinders 58 and 70 may be connected by welding a toroidal curved steel plate 148 between their free ends.

Figure 5:
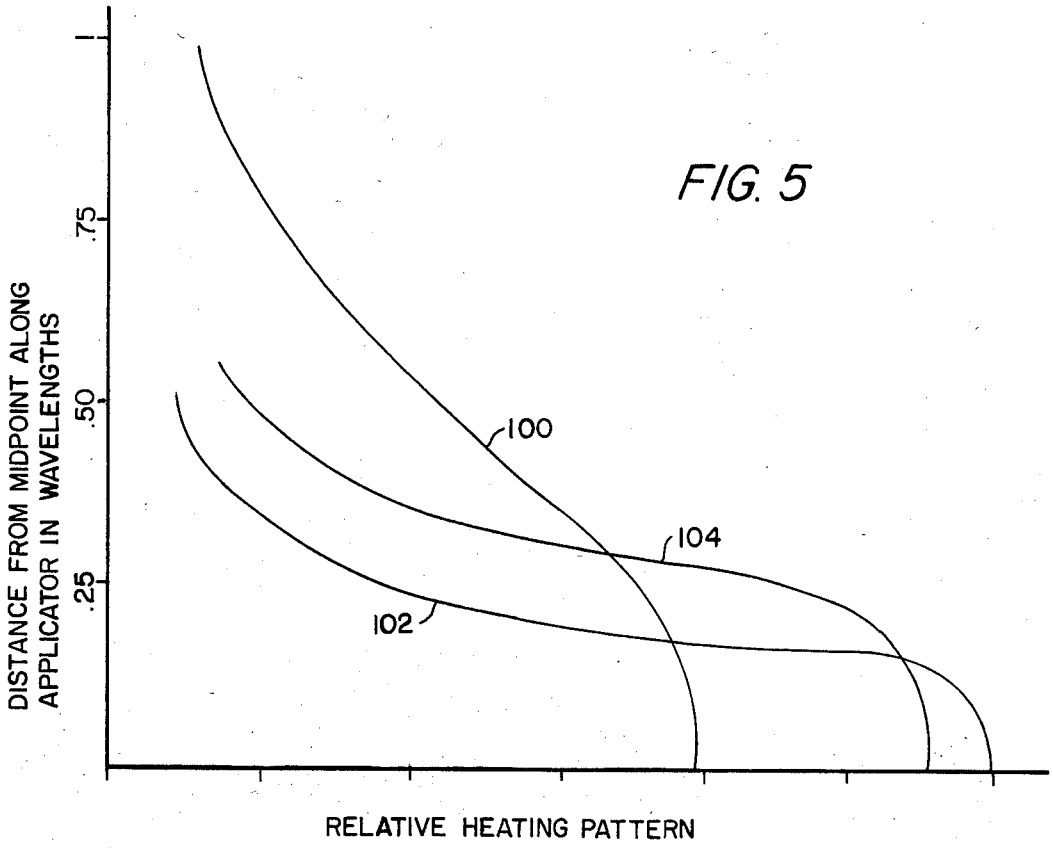
FIG. 5 illustrates a diagram of relative heating patterns along the upper half of the dipole radiator of the invention.

Referring now to FIG. 5, there is shown relative heating patterns typical of those produced in the oil shale by electric fields radiated from the radiator in accordance with this invention. Plotted along the vertical axis is vertical distance up from the center of the dipole radiator and plotted along the horizontal axis is the relative heating pattern. The curves are shown by way of illustration only and their temperature values will change as functions of heating time, and distance from the applicator. Curve 100 shows a plot of the heating pattern which can be expected if the dielectric 68 is omitted, and the effective wavelength distance into the space between conductive cylinders 46 and 56 is around one ninth of a wavelength. This curve has a very broad vertical pattern in which the heating dies off exponentially over a distance of several wavelengths back up along the transmission line 30 thereby reducing the heating pattern in the region radially outward from the radiator. Also, impedance matching to line 30 is poor.

Curve 102 illustrates a heating pattern expected when the dielectric 68 is in the cavity and the frequency is adjusted for resonance of the dielectric filled cavity 35 such that the length from plate 52 to the upper end 33 of cylinder 56 is an electrical quarter wavelength. Impedance matching to line 30 is good and the heating pattern is much more directive in the vertical plane.

Curve 104 illustrates the heating pattern obtained when dielectric 68 is used in the cavity and the applied frequency is shifted to be 15% different from the resonant frequency used to produce curve 100. Curve 104 is less directive vertically than curve 100 but is much more vertically directive than curve 102. The terms "directive" and "directivity", as used herein, are used in the same way as they are conventionally used in describing the electric field patterns about antennas since such electric field patterns produce the heating patterns in the oil shale. Thus, it may be seen that by the use of a properly loaded cavity coupled to the free ends of the dipole radiators, substantially greater directivity of the radiated pattern in the vertical plane may be obtained.

Figure 6:
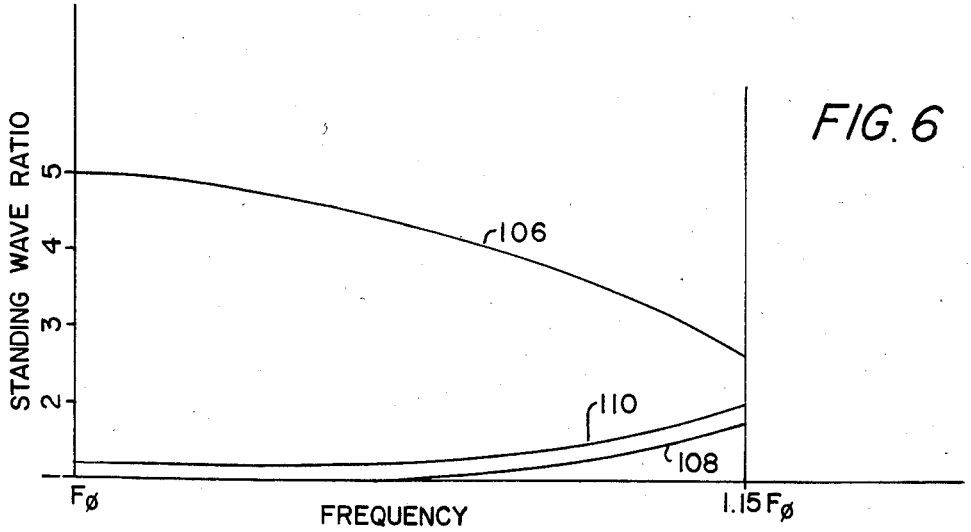
FIG. 6 illustrates a plot of the standing wave ratio of the invention as a function of deviation of frequency from the resonant frequency.

Referring now to FIG. 6, there is shown a plot of standing wave ratio as measured at the input to transmission line 30 versus frequency. The curve 106 illustrates the high standing wave ratio even at resonant frequency of the dipole radiator 32 in the oil shale 14 such that relatively low power is coupled into the radiator 32. The standing wave ratio at 15% off resonance is also substantially different depending on the electrical wavelength distance from the RF generator 86 to the radiator 32 along the transmission line 30. This extreme sensitivity to frequency and the resultant power reflection produced by the high standing wave ratio causes the major portion of the RF power to be absorbed in the several reflections back and forth along the several hundred feet of the transmission line 30. Thus, even with optimum matching conditions using resonance within the transmission line, coupling of substantial amounts of the RF power into the oil shale, to the desired radial distance, is not easily achieved. Curve 108 illustrates the standing wave ratio when the dielectric 68 is used. Curve 108 shows frequency varied from resonance to 15% away from resonance. At resonance, the transmission line 30 is selected to be substantially matched to the radiating structure 32 when the oil shale 14 is in contact with the radiating surfaces of the dipoles. Transmission line 30 is mismatched to the radiator 32 by less than 2 to 1 when the frequency is 15% different from the resonant frequency.

Curve 110 illustrates the condition where a radiating structure, selected to be impedance matched when in contact with a typical oil shale body, has the radiating conductive surfaces spaced from the oil shale by approximately one-half the radius of the radiating cylinder 56. At resonant frequency, curve 110 shows standing wave ratio of approximately 1.2 and as the frequency is shifted off resonance by 15%, the standing wave ratio increases gradually to approximately 2. Applicant has discovered that this extremely broad frequency range and low standing wave ratio is a predominant result of increasing the impedance coupled to the free end of the radiating cylinder 56 by resonating the cavity filled with the dielectric 68.

This completes the description of the specific embodiment of the invention illustrated herein. However, many modifications thereof will be apparent to persons of ordinary skill in the art without departing from the spirit and scope of this invention. For example, materials other than steel could be used for the radiating cylinders and other insulators could be used for the cast dielectric disclosed herein. Also, other shapes and cross-sectional dimensions of the radiating structures could be used, and the radiating structure may be used between pairs of wells spaced less than a tenth of a wavelength apart and with power supplied between the central conductors of the lines of adjacent wells to drive the lower section 38 of the structure. Accordingly, it is intended that this invention be not limited by the particular details of the embodiment illustrated herein except as defined by the appended claims.

What is claimed is:

1. A subsurface radiating system comprising:

a dipole antenna having first and second radiating elements radiating into a subsurface medium having a dielectric constant substantially greater than unity;

each of said radiating elements having a conductive portion forming a portion of a cavity;

a transmission line having an inner conductor surrounded by an outer conductor electrically connected between said radiating elements, said outer conductor being connected to said first of said radiating elements and said inner conductor being connected to said second of said radiating elements; and means comprising a solid dielectric within said cavity portion of each of said radiating elements for producing resonant loading of a free end of said first one of said dipole radiating elements and for providing structural reinforcement for said first and second radiating elements.

2. The radiating system in accordance with claim 1 wherein said loading means comprises a solid dielectrically loaded quarter wave choke structure.

3. The radiating system in accordance with claim 1 wherein:

said solid dielectric substantially surrounds said transmission line in said cavity of said first one of said radiating elements.

4. The radiating system in accordance with claim 1 wherein:

said cavity of said first of said radiating elements comprises a region between an inner surface portion of said first of said radiating elements and an outer surface of said outer conductor of said transmission line, said cavity being substantially filled with said solid dielectric to produce loading of the free end of said first one of said elements.

5. The radiating system in accordance with claim 1 wherein:

said cavity of said second of said radiating elements comprises a region between an inner surface portion of said second of said radiating elements and an outer surface of a conductor having a same diameter as said outer conductor, said conductor being electrically connected to said inner conductor and said second of said radiating elements, and extending downwardly parallel to said second of said radiating elements, said cavity being substantially filled with said solid dielectric.

6. A subsurface radiator comprising:

a dipole antenna consisting of first and second radiating elements;

means for connecting a transmission line between said radiating elements; and means comprising a solid dielectric in each of said radiating elements, having a dielectric constant substantially greater than unity for providing a resonant load, coupled to a free end of said first one of said dipole radiating elements when said one of said radiating elements is radiating into a medium having a dielectric constant substantially greater than unity, said solid dielectric means providing structural reinforcement for each of said first and second radiating elements against radial forces produced in said medium.

7. The radiator in accordance with claim 6 wherein said load comprises a solid dielectrically loaded quarter wave choke structure.

8. The radiator in accordance with claim 6 wherein said load comprises a solid dielectric surrounding said transmission line.

9. The radiator in accordance with claim 6 wherein said transmission line comprises an inner conductor surrounded by an outer conductor; and the space between the inner surface of a cavity portion of said first one of said radiating elements and the outer surface of said coaxial line being substantially filled with a solid dielectric medium whose dielectric constant is greater than unity to form a resonant structure coupled to the free end of said first one of said elements.

10. A subsurface radiating system comprising:

an antenna having first and second radiating elements radiating into a subsurface medium having a dielectric constant substantially greater than unity;

each of said radiating elements having a conductive portion forming a portion of a cavity;

a transmission line connected to said elements; and means comprising a solid dielectric within said cavity portion of each of said radiating elements for providing a resonant load whose impedance is substantially greater than the input impedance to said antenna and which is coupled to a free end of said first one of said radiating elements, and for providing structural reinforcement for said first and second radiating elements.

11. The radiating system in accordance with claim 10 wherein said load means comprises a solid dielectrically loaded quarter wave choke structure.

12. The radiating system in accordance with claim 10 wherein said solid dielectric within said cavity of said first one of said radiating elements substantially surrounds said transmission line.

13. The radiating system in accordance with claim 12 wherein said transmission line comprises an inner conductor surrounded by an outer conductor; and said cavity comprises a region between an inner surface portion of said first one of said radiating elements and an outer surface of said outer conductor of said transmission line, said cavity being substantially filled with said solid dielectric.

14. A subsurface radiator comprising:

an antenna having first and second radiating elements;

means for connecting a transmission line to said antenna;

means in each of said radiating elements comprising a solid dielectric having a dielectric constant substantially greater than unity and providing a resonant load coupled to a free end of said first one of said radiating elements when said radiating elements are radiating into a medium having a dielectric constant substantially greater than unity;

said transmission line comprising an inner conductor surrounded by an outer conductor; and the space between the inner surface portion of said first one of said radiating elements and an outer surface of said outer conductor of said transmission line being substantially filled with said solid dielectric whose dielectric constant is greater than unity to form said resonant load means, the space between an inner surface portion of said second of said radiating elements and an outer surface of a conductor having a same diameter as said outer conductor, said conductor being electrically connected to said inner conductor and said second of said radiating elements and extending downwardly parallel to said second of said radiating elements, being substantially filled with said solid dielectric.

15. A subsurface radiator comprising:

a dipole antenna having first and second radiating elements;

each of said radiating elements having a conductive portion forming a portion of a cavity, each cavity comprising a solid dielectric means;

means for connecting a transmission line between said radiating elements; and said solid dielectric means having a propagation wave velocity substantially less than that of free space and providing a resonant load coupled to a free end of said first one of said radiating elements when said first one of said radiating elements is radiating into a medium having a propagation velocity substantially less than that of free space.

16. The radiator in accordance with claim 15 wherein said loading means comprises a quarter wave choke structure.

17. The radiator in accordance with claim 15 wherein:

said solid dielectric means in said cavity of said first one of said radiating elements surrounds said transmission line.

18. The radiator in accordance with claim 15 wherein said transmission line comprises an inner conductor surrounded by an outer conductor; and the space between the inner surface portion of said first one of said radiating elements and an outer surface of said outer conductor of said transmission line being substantially filled with said solid dielectric means whose dielectric constant is greater than unity to form a resonant structure loading said free end of said dipole antenna.

19. The radiator in accordance with claim 15 wherein:

said cavity of said second of said radiating elements comprises a region between an inner surface portion of said second of said radiating elements and an outer surface of a conductor having a same diameter as said outer conductor, said conductor being electrically connected to said inner conductor and said second of said radiating elements, and extending downwardly parallel to said second of said radiating elements, said cavity being substantially filled with said solid dielectric.

20. A subsurface radiating system comprising:

a dipole antenna having first and second radiating elements radiating into a subsurface body of oil shale;

each of said elements having a conductive portion forming a portion of a cavity substantially filled with a solid dielectric;

a transmission line electrically connected between the midpoint of said dipole antenna and an inner and outer conductor of said transmission line; and said transmission line being surrounded by said solid dielectric within said cavity portion of said first one of said radiating elements of said dipole antenna.

21. The radiating system in accordance with claim 20 wherein said solid dielectric comprises a quarter wave choke structure.

22. The radiating system in accordance with claim 20 wherein said inner conductor of said transmission line is surrounded by said outer conductor with a region between an inner surface portion of said first one of said radiating elements and an outer surface of said outer conductor of said transmission line, said cavity being substantially filled with said solid dielectric to produce loading of a free end of said dipole antenna.

23. The radiating system in accordance with claim 20 wherein:

said cavity of said second of said radiating elements comprises a region between an inner surface portion of said second of said radiating elements and an outer surface of a conductor having a same diameter as said outer conductor, said conductor being electrically connected to said inner conductor and said second of said radiating elements, and extending downwardly parallel to said second of said radiating elements, said cavity being substantially filled with said solid dielectric.

* * * * *